United States Patent [19]

Sando et al.

[11] Patent Number: 4,611,370

[45] Date of Patent: Sep. 16, 1986

[54] SINGEING APPARATUS FOR CLOTH

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 744,468

[22] Filed: Jun. 13, 1985

[30] Foreign Application Priority Data

Jun. 13, 1984 [JP] Japan ..... 59-87738[U]

[51] Int. Cl.[4] ..... D06C 9/02

[52] U.S. Cl. ..... 26/3

[58] Field of Search ..... 26/3; 28/174, 239

[56] References Cited

U.S. PATENT DOCUMENTS

| | | | |
|---|---|---|---|
| 3,134,158 | 5/1964 | Marks, Jr. | 26/3 |
| 3,448,498 | 6/1969 | Sando et al. | 26/3 |
| 4,332,063 | 6/1982 | Ehrhardt | 26/3 |

FOREIGN PATENT DOCUMENTS

| | | | |
|---|---|---|---|
| 50-37795 | 12/1975 | Japan | 26/3 |

OTHER PUBLICATIONS

Osthoff-Senge Double Jet, Walter Osthoff KG Maschinenfabrik, 56 Wuppertal 13 (Germany).

*Primary Examiner*—Robert R. Mackey

*Attorney, Agent, or Firm*—Toren, McGeady, Stanger, Goldberg & Kiel

[57] ABSTRACT

A singeing apparatus comprises a guide drum for guiding a cloth to be singed and a singeing gas burner which blows flame against the cloth guided by the guide drum and is located opposite the guide drum. A structure is provided so that warm water can be made to flow in the guide drum and the temperature at a surface of the guide drum is maintained at the dew-point temperature of ambient air.

1 Claim, 3 Drawing Figures

SINGEING APPARATUS FOR CLOTH

BACKGROUND OF THE INVENTION

1. Field of the Invention

The present invention relates to an improvement of a singeing apparatus for singeing fluff on the surface of a cloth.

2. Description of the Prior Art

Heretofore, this type of singeing apparatus was such that a cloth 1 to be singed was transported by a guide drum 2, as shown in FIG. 1 by way of example, and a flame from a gas burner 3 was blown against the cloth which is guided in contact with the guide drum 2 for continuously singeing the fluff at a surface of the cloth 1. However, the surface of the guide drum 2 which guides the cloth 1 is heated to a high temperature under a dry heat state by the continuous operation of the singeing apparatus, therefore the surface of this guide drum 2 had carbide or yarn waste or thread waste, etc. (hereinafter called a scale) sticking to the cloth surface and solidifying, and the surface of the guide drum became uneven, with the further drawback that wrinkles are formed on the cloth being guided.

Therefore, it is necessary to regularly clean the surface of the cloth guide drum in a singeing apparatus. Such cleaning operation has been done by operators with the operation of the apparatus stopped every time the cleaning is performed, which has created problems of poor productivity and lost time for the cleaning.

SUMMARY OF THE INVENTION

The purpose of the present invention is to eliminate the prior art problems and it is an object of the present invention to provide a singeing apparatus having such a cloth guide drum arranged so that moisture is always given to the surface of the cloth guide drum in the singeing apparatus whereby the adhesion of scale on the surface of the cloth guide drum can be reduced.

DESCRIPTION OF THE PREFERRED EMBODIMENT

Figure 1:
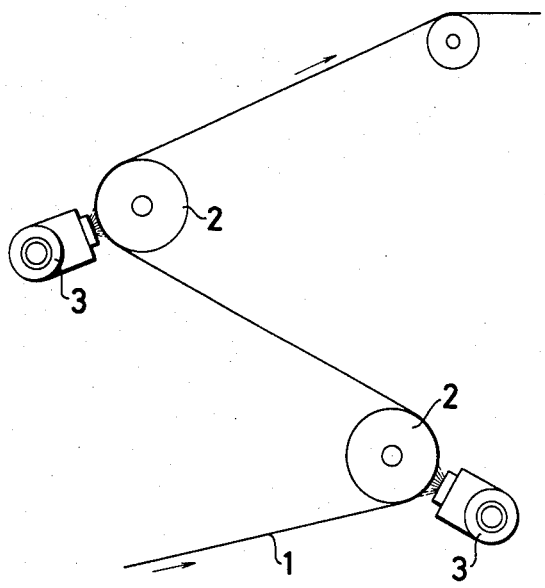
FIG.1 PRIOR ART
FIG. 1 is a schematic view showing a prior art singeing apparatus.
Figure 2:
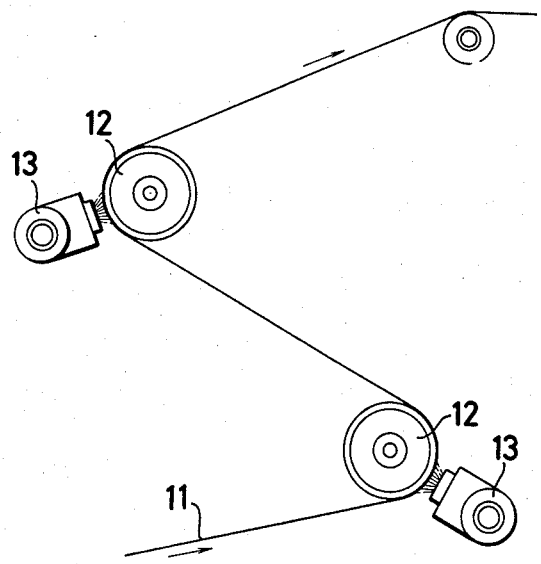
FIGS. 2 and 3 are schematic views illustrating an embodiment of a singeing apparatus according to the present invention.
Figure 3:
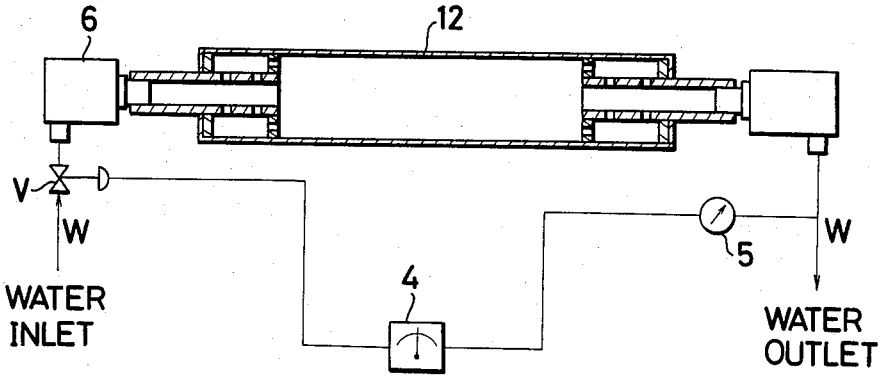

The present invention shall be explained based on the device shown in FIGS. 2 and 3.

In FIG. 2, 11 is a long cloth to be singed, 12 is a guide drum for guiding the cloth 11, and a gas burner 13 for flowing flame against the guide drum 12 is disposed opposite to the drum. An ordinary gas singeing apparatus consists of the combination of the gas burner 13 and the guide drum 12, but the guide drum 12 in the inventive embodiment is arranged so that cold water can flow through the inside of the drum. A structure for flowing cold water into the guide drum 12 may be a known structure wherein a water inlet is provided at one end of the guide drum and a water outlet is provided at the other end of the same, and water is supplied as the guide drum is rotated. The purpose of supplying water into the guide drum is to supply water to the inside of the guide drum 12 which is heated by the gas burner 13 for cooling down the surface temperature of the guide drum to near the dew-point temperature, so that the surface of the guide drum 12 is always maintained in a wet state thus preventing sticking of the scale. Also, while cold water flows into the inside of the guide drum 12 in the above description, warm water may be used in place of cold water. That is, the temperature of the liquid may be lower than the surface temperature of the guide drum 12 which is heated by the gas burner 13. As a concrete arrangement, the temperature of the surface of the guide drum is maintained at the dew-point temperature of the ambient air surrounding the drum by controlling the amount of warm water coming out of the drum so as to keep its temperature at a prescribed value corresponding to the temperature of the surface of the drum. There is a definite correlation between the temperature of the water coming out of the drum and that of the surface of the drum in accordance with the construction of the apparatus.

In FIG. 3 showing the present apparatus more specifically, the water W is circulated through the drum 12 supported by the rotary joint 6. The temperature of the drum surface is determined by detecting the temperature of the water coming out of the drum by the temperature detector 5 and the dew-point temperature of the ambient air surrounding the surface of the drum is determined by the dew-point temperature detecting device 4. Based on the difference between the drum surface temperature and the dew-point temperature, the flow rate of the water to be circulated through the drum is controlled by a valve V for maintaining the surface of the drum equal or almost equal to the dew-point of the ambient air.

As has been explained above, the present invention relates to a singeing apparatus comprising a guide drum for guiding a cloth to be singed and a gas singeing burner which is arranged opposite to the guide drum for blowing flame against the cloth guided by the guide drum, and is characterized by such structure that warm water flows in the inside of the guide drum for maintaining the temperature at the surface of the guide drum at the dew-point temperature of ambient air.

Therefore, dew is formed at the surface of the guide drum located opposite to the gas burner in this singeing apparatus, and the surface of the guide drum is always maintained in a wet state, therefore, there is the effect that the surface of the guide drum is kept in a cleanly wiped state as it contacts with the cloth being transported, thus sticking of scale can be prevented.

What is claimed is:

1. A singeing apparatus for a cloth includes a guide drum for continuously guiding the cloth to be singed and a singeing gas burner located closely opposed to the guide drum for blowing flame against the cloth guided by the guide drum, comprising means for flowing warm water through the interior of the guide drum including a valve for controlling the flow rate of the water, a device for detecting the dew-point temperature of the ambient air surrounding the guide drum and a device for detecting the temperature of the water coming out of the guide drum for determining the temperature at the surface of the guide drum whereby the temperature of the surface of the guide drum can be maintained approximately at the dew-point temperature of the ambient air surrounding the guide drum by controlling the amount of warm water flowing into the guide drum.

* * * * *